United States Patent [19]

Lyle

[11] Patent Number: 4,932,377

[45] Date of Patent: Jun. 12, 1990

[54] MULTIVALVE CYLINDER ENGINE

[75] Inventor: Alastair C. Lyle, Blisworth, England

[73] Assignee: Tickford Limited, Milton Keynes, United Kingdom

[21] Appl. No.: 281,228

[22] Filed: Dec. 8, 1988

[30] Foreign Application Priority Data

Dec. 8, 1987 [GB] United Kingdom ..... 8728660

[51] Int. Cl.[5] ..... F02B 15/00

[52] U.S. Cl. ..... 123/432; 123/188 M; 123/308

[58] Field of Search ..... 123/432, 188 M, 308

[56] References Cited

U.S. PATENT DOCUMENTS

| | | | |
|---|---|---|---|
| 4,549,510 | 10/1985 | Miyakoshi | 123/432 |
| 4,617,896 | 10/1986 | Yoshikawa | 123/188 M |
| 4,622,940 | 11/1986 | Yoshikawa | 123/432 |
| 4,766,866 | 8/1988 | Takii | 123/432 |
| 4,805,569 | 2/1989 | Suzumura et al. | 123/188 M |

*Primary Examiner*—E. Rollins Cross
*Attorney, Agent, or Firm*—Scrivener and Clarke

[57] ABSTRACT

An internal combustion engine in which each cylinder has a plurality of inlet ports (17,19) and a plurality of outlet ports (14), each port being openable and closeable by means of a respective valve (12,13,11). The inlet and outlet valves (12,13,11) are disposed with their center lines substantially on opposite sides of a cylinder center plane (16) and angled generally towards said center plane (16). There are three, or possibly more, valves on at least one of said sides, arranged with two outer valves (12) separated by one, or possibly more, inner valve (13). The angle of inclination with respect to said center plane (16) for the outer valves (12) is less than or equal to the angle of inclination for the inner valve (13). The valves are preferably operated directly with a separate camshaft (18,20,15) being provided for each one or more valves inclined at the same angle.

6 Claims, 4 Drawing Sheets

MULTIVALVE CYLINDER ENGINE

The present invention relates to a multivalve per cylinder engine. More particularly, but not exclusively, it relates to an arrangement of valves for use with such internal combustion engines.

It is known to provide multiple valves per cylinder in engines. Such multiple valves can be advantageous, especially at high speeds, since the valve area can be increased to improve the intake and outlet efficiencies. Alternatively or additionally, the valves themselves may be made smaller and lighter. A common arrangement is to have three inlet valves and two outlet valves, the five valves being disposed equiangularly around the cylinder head. It is of course possible to increase the number of valves still further.

One problem with such arrangements is the means of operating the valves. In conventional engines, the two valves can easily be operated either by a single camshaft or by a pair of camshafts passing above the cylinder head. However, this is more difficult with five or more valves and several attempts have been made to solve the problem. One method disclosed in British patent specification no. 296125, and also in European patent specification no. 0063385 is to angle the valve stems so that all of the inlet valves may be operated by a common cam shaft and all of the outlet valves by another.

However, this system, while effective for camshaft purposes, raises other problems. Taking as an example a system where there are three inlet valves disposed on one side of the cylinder centre line, (in fact only the centre lines of the three valves are generally on one side of the cylinder centre line - as is common practice in most 5-valve designs, part of some of the valve heads will cross the cylinder centre line) it can be seen that two valve heads are closer to the centre line than an intermediate valve head. From the single camshaft, the line of the centre valve must diverge from the line of the outer valves so that they arrive at the allotted positions in the cylinder head. It is common to employ concave domed cylinder heads and ideally, the faces of the valve heads should follow this domed configuration. This is impossible with the systems disclosed in the above two patents since, looking across the cylinder, those nearest the centre line are more angled than is the one further from the centre line.

It also follows that the ports closed by the valves exit from the cylinder head at different angles. All this makes for unnecessary complications in the design of the cylinder head and/or piston.

It is an object of the present invention to provide a multivalve cylinder head design which overcomes the above disadvantages.

According to the present invention there is provided an internal combustion engine in which each cylinder thereof has a plurality of inlet ports and a plurality of outlet ports, each port being openable and closeable by means of a respective valve, the inlet and outlet valves being disposed substantially on opposite sides of a cylinder centre plane and angled generally towards said centre plane, there being at least three valves on at least one of said sides, of which at least three valves two outer valves are separated by at least one inner valve, the angle of inclination with respect to said centre plane for said outer valves being less than or equal to the angle of inclination for said at least one inner valve.

Preferably there are three inlet valves, and optionally two outlet valves.

All the valves may be operated indirectly by a single camshaft through finger followers or the like. Alternatively and preferably, the valves may be operated directly, a separate camshaft being provided for each one or more valves inclined at the same angle.

The separate camshafts may be connected by means of a gearing arrangement.

The valves may each be disposed in parallel planes transverse to said central plane.

An embodiment of the present invention will now be more particularly described by way of example and with reference to the accompanying drawings, in which.

Figure 1:
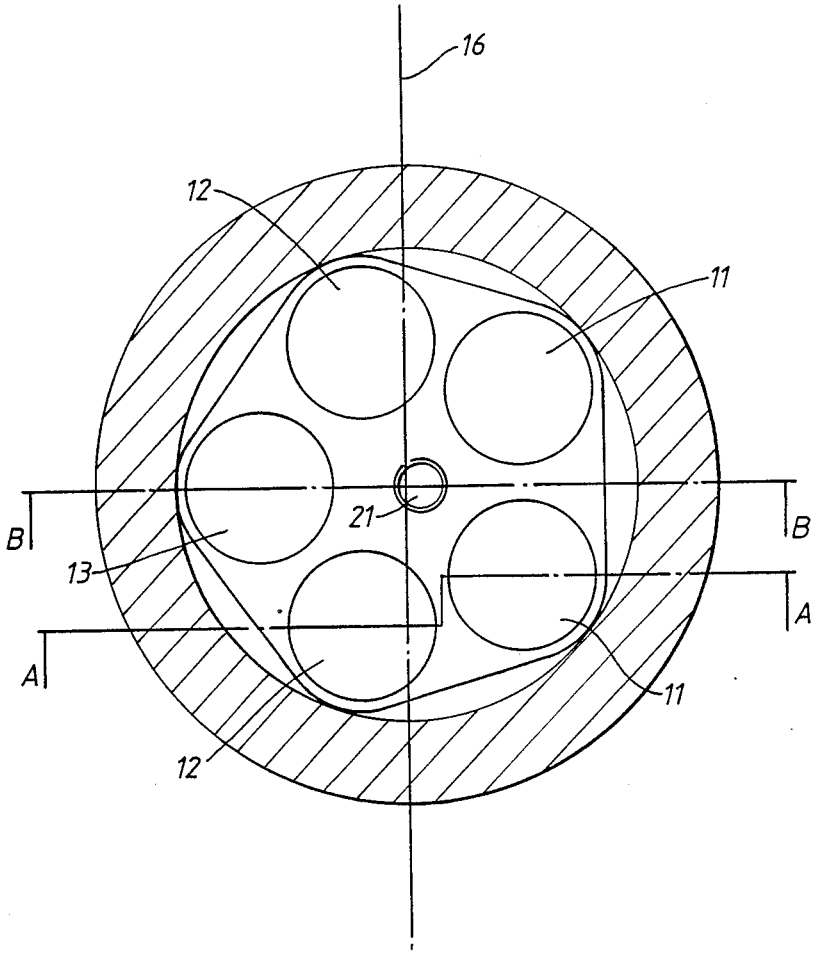
FIG. 1 is a view of a 5-valve per cylinder combustion chamber embodying the invention.
Figure 2:
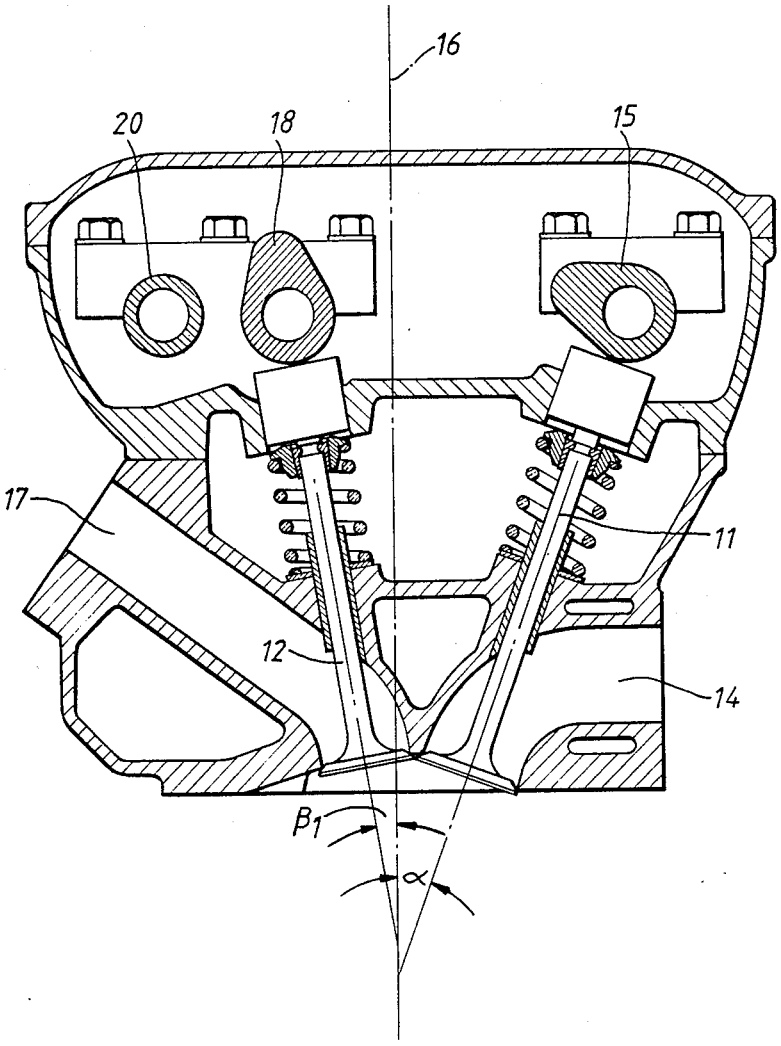
FIG. 2 is a cross-sectional view taken along the line AA of FIG. 1.

Referring now to the drawings, there is shown a 5-valve cylinder, and in FIGS. 1 and 2 outlet valves 11, outer inlet valves 12 and central inlet valve 13 are indicated.

Referring now to FIG. 2, an outlet port 14 is closed by an outlet valve 11, operation of which is controlled by an outlet cam 15. Both outlet valves 11 are disposed at the same angle of inclination $\alpha$ to the centre plane 16 of the cylinder and are parallel one to another.

Outer inlet ports 17 are closed by outer inlet valves 12, operated by outer inlet camshaft 18. Both outer inlet valves are parallel and are inclined similarly with respect to centre plane 16 at angle $\beta_1$.

Figure 3:
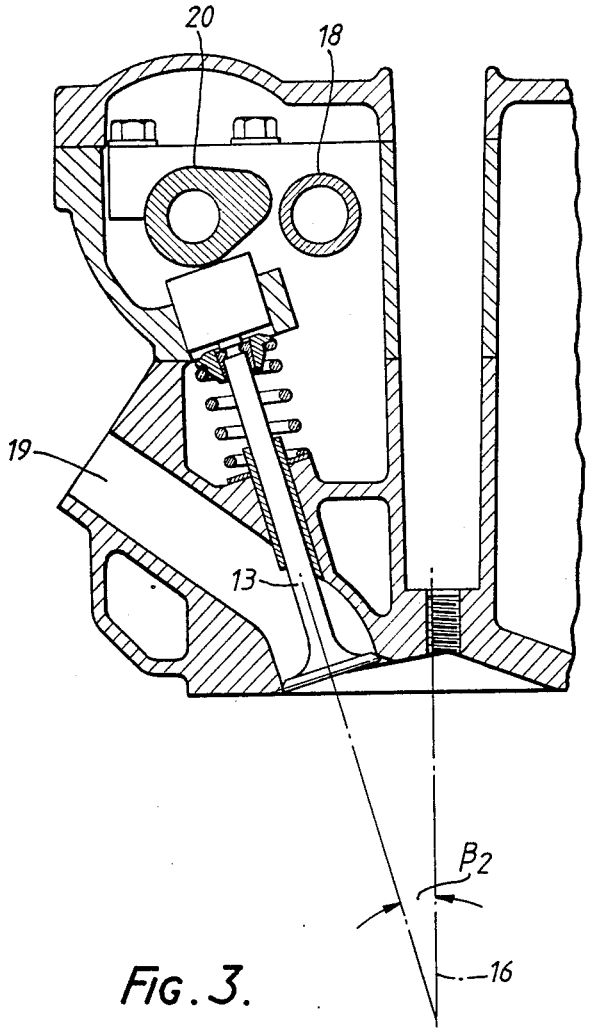
FIG. 3 is a cross-sectional view of the cylinder head taken along the line BB of FIG. 1.

Referring now to FIG. 3, central inlet port 19 is closed by central inlet valve 13, operated by means of central inlet camshaft 20. Central inlet valve 13 is parallel to the other valves and inclined at angle $\beta_2$ with respect to the central plane 16.

The various components of the valves, camshafts and ports are generally conventional and will not be described in more detail. A conventional spark plug 21 is provided in a substantially central location between the inlet and outlet valves.

As can be seen from FIGS. 2 and 3, the inlet valves converge from their respective camshafts towards the centre plane of the cylinder. Thus the faces of the inlet valves, which are normal to the valve stems, approximate much more closely to the desired domed configuration of the cylinder head. In fact, by appropriate design of the cylinder head, the ports leading thereto may all be bored at the same angle thus facilitating the process of construction. Furthermore, since no two adjacent valves converge as they leave the cylinder head, there is more room at their upper ends in which to accommodate valve springs and tappets.

Figure 4:
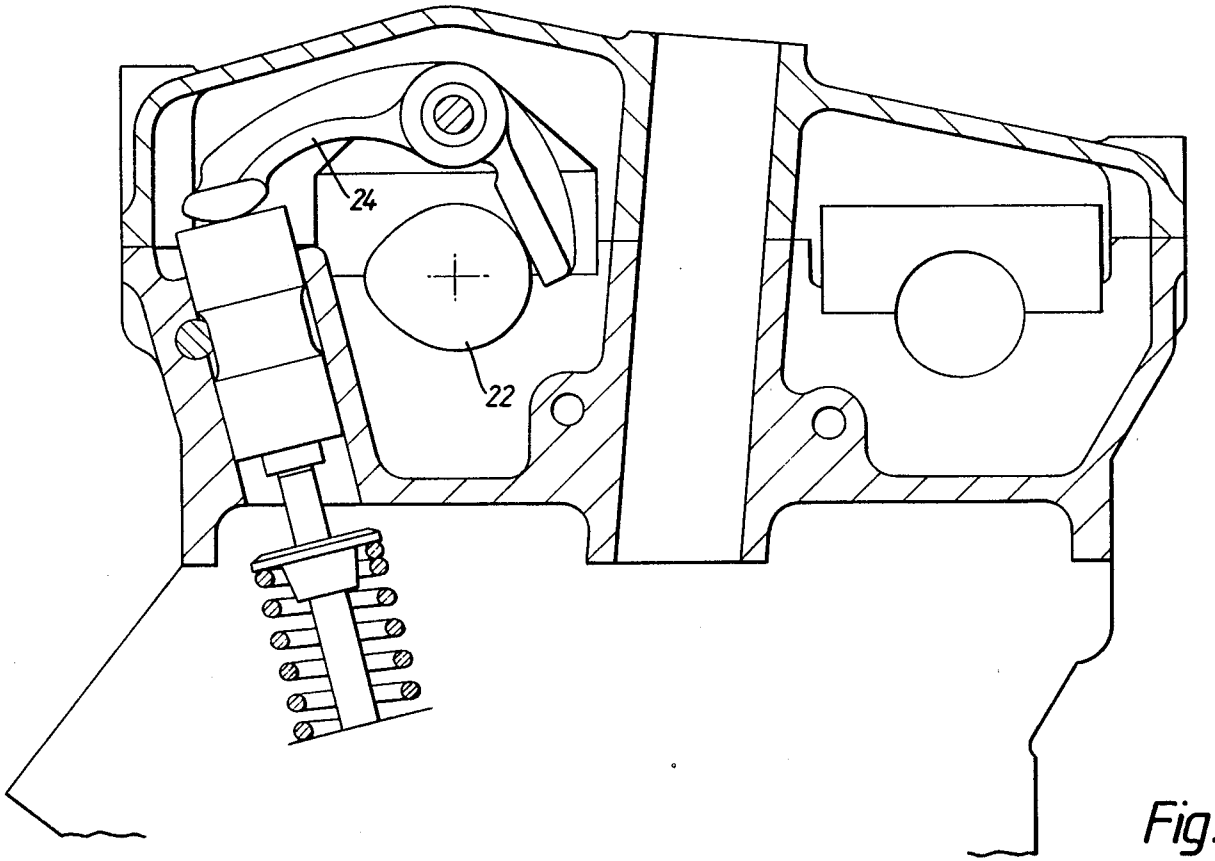
FIG. 4 is a vertical cross sectional view showing an alternate means for operating the valves.

As an alternative to this multi-camshaft arrangement, and as seen in FIG. 4 a single camshaft 22 may be provided to operate the various valves by means of finger followers 24. In another alternative, twin camshafts are provided, one for all the inlet valves operated via finger followers, and one for the outlet valves.

As can be seen, the arrangement of valves allows more room for their operating parts and allows a better shape for the combustion chamber of the cylinder. Construction of the cylinder head is easier since the ports may be bored at the same angle with respect to the cylinder head.

The invention has been described with respect to three inlet valves and two outlet valves. More or less of either could of course be substituted.

I claim

1. An internal combustion engine in which each cylinder thereof has a plurality of inlet ports and a plurality of outlet ports, each port being openable and closeable by means of a respective valve, the inlet and outlet valves being disposed substantially on opposite sides of a cylinder centre plane; each said valve lying in a respective plane transverse to said centre plane and each said valve being angled generally towards said centre plane, said transverse planes being parallel one to another; there being at least three valves on a first one of said sides, arranged with two outer valves separated by at least one inner valve, the angle of inclination with respect to said centre plane for said outer valves being less than the angle of inclination for said at least one inner valve.

2. An engine as claimed in claim 1, comprising three inlet valves on said first side.

3. An engine as claimed in claim 2, comprising two outlet valves on said second side.

4. An engine as claimed in claim 1, wherein at least some of the valves are operated indirectly from at least one camshaft through finger follower means.

5. An engine as claimed in claim 1, wherein at least some of said valves on the respective opposite sides of said centre plane are arranged in groups inclined at the same angle wherein each group of valves inclined at the same angle is operated directly by a respective camshaft.

6. An engine as claimed in claim 5, wherein there are provided a first camshaft to operate said two outer valves; a second camshaft to operate said at least one inner valve; and a third camshaft to operate at least one valve on a second of said sides.

* * * * *